US011913456B2

(12) United States Patent
Lee et al.

(10) Patent No.: US 11,913,456 B2
(45) Date of Patent: Feb. 27, 2024

(54) ROTARY VANE COMPRESSOR WITH RESIDUAL REFRIGERANT REMOVAL

(71) Applicant: LG Electronics Inc., Seoul (KR)

(72) Inventors: Jingyu Lee, Seoul (KR); Sangmin Na, Seoul (KR)

(73) Assignee: LG Electronics Inc., Seoul (KR)

( * ) Notice: Subject to any disclaimer, the term of this patent is extended or adjusted under 35 U.S.C. 154(b) by 550 days.

(21) Appl. No.: 17/060,646

(22) Filed: Oct. 1, 2020

(65) Prior Publication Data

US 2021/0215397 A1 Jul. 15, 2021

(30) Foreign Application Priority Data

Jan. 15, 2020 (KR) ..... 10-2020-0005567

(51) Int. Cl.
*F04C 29/12* (2006.01)
*F01C 21/08* (2006.01)
*F04C 18/324* (2006.01)

(52) U.S. Cl.
CPC ..... *F04C 29/12* (2013.01); *F04C 18/324* (2013.01); *F01C 21/0809* (2013.01)

(58) Field of Classification Search
CPC ..... F01C 21/0809; F04C 18/324; F04C 29/12
See application file for complete search history.

(56) References Cited

U.S. PATENT DOCUMENTS 9,004,888 B2 * 4/2015 Morishita ..... F04C 29/12 418/60
2005/0220655 A1 10/2005 Cho
2017/0218956 A1 8/2017 Lee et al.

FOREIGN PATENT DOCUMENTS

| | | |
|---|---|---|
| CN | 207033735 | 2/2018 |
| EP | 3739214 | 11/2020 |
| EP | 3744947 | 12/2020 |
| JP | H11315793 | 11/1999 |
| JP | 2010168977 | 8/2010 |
| JP | 2013076337 A * | 4/2013 |
| JP | 2014088836 | 5/2014 |
| JP | 2016160793 | 9/2016 |

(Continued)

OTHER PUBLICATIONS

EP Extended European Search Report in European Appln. No. 20211230.6, dated Apr. 9, 2021, 7 pages.

(Continued)

*Primary Examiner* — Mary Davis
(74) *Attorney, Agent, or Firm* — Fish & Richardson P.C.

(57) ABSTRACT

A rotary compressor includes at least one cylinder in which a discharge guide groove is disposed at one side of a vane slot; a roller orbitably provided in the cylinder, and disposed with a hinge groove on an outer circumferential surface thereof; a vane in which one end portion thereof is rotatably inserted into the hinge groove of the roller, and the other end portion thereof is slidably inserted into the vane slot of the cylinder; and a plurality of bearing plates that seals both side surfaces of the cylinder, and at least one side of which is disposed with a discharge port to communicate with the discharge guide groove. The discharge port communicates with a refrigerant residual space defined between the vane slot and the discharge guide groove. Refrigerant in the refrigerant residual space may be discharged even after the roller passes through the discharge guide groove.

7 Claims, 11 Drawing Sheets

(56) References Cited

FOREIGN PATENT DOCUMENTS

| | | | |
|---|---|---|---|
| KR | 1020160034071 | | 3/2016 |
| WO | WO-2021201033 | A1 * | 10/2021 |

OTHER PUBLICATIONS

KR Office Action in Korean Appln. No. 10-2020-0005567, dated Feb. 22, 2021, 9 pages (with English translation).
Office Action in European Appln. No. 20211230.6, dated Mar. 10, 2023, 7 pages.

* cited by examiner

ROTARY VANE COMPRESSOR WITH RESIDUAL REFRIGERANT REMOVAL

CROSS-REFERENCE TO RELATED APPLICATION

Pursuant to 35 U.S.C. § 119(a), this application claims the benefit of an earlier filing date of and the right of priority to Korean Patent Application No. 10-2020-0005567, filed on Jan. 15, 2020, the contents of which are incorporated by reference herein in its entirety.

TECHNICAL FIELD

The present disclosure relates to a rotary compressor, and more particularly, to a rotary compressor in which a roller and a vane are coupled to each other.

BACKGROUND

A rotary compressor compresses refrigerant using a roller performing an orbiting movement in a compression space of a cylinder and a vane in contact with an outer circumferential surface of the roller to partition the compression space of the cylinder into a plurality of spaces.

The rotary compressor may be divided into a rolling piston type and a hinge vane type according to whether the roller and the vane are coupled to each other. The rolling piston type is a type in which the vane is detachably coupled to the roller so that the vane is closely attached to the roller, and the hinge vane type is a type in which the vane is hinge-coupled to the roller. Patent Document 1 and Patent Document 2 each disclose a hinge vane type, the hinge vane type has a stable vane behavior compared to the rolling piston type, thereby reducing axial leakage.

The rotary compressor generates a gas force in the compression space during the compression process, and the vane receives a force in a width direction by the gas force. However, as a rear side of the vane is coupled to a vane slot, the vane transmits a force in the width direction to the vane slot of the cylinder. Then, cylinder reaction forces acting in opposite directions while being orthogonal to the vane slot are generated on inner and outer circumferential sides of the vane slot. This pair of cylinder reaction forces act as a couple of forces as they are generated at preset intervals in a length direction of the vane. Therefore, when the vane reciprocates, a side surface of the vane and a sidewall surface of the vane slot may be pressed against each other to cause friction loss or side wear while increasing side pressure.

Such friction loss or side wear due to an increase of the side pressure may be greater in the hinge vane type as in Patent Document 1 and Patent Document 2 than in the rolling piston type, thereby reducing compressor efficiency or reducing reliability.

In addition, in the rotary compressor, refrigerant remains in a space (hereinafter, referred to as a refrigerant residual space) disposed between a side surface of the vane and one end of a discharge guide groove, and an outer peripheral surface of the roller even when discharge to the relevant compression chamber is completed due to the characteristics thereof, and the refrigerant remaining in this refrigerant residual space rises above a discharge pressure as the compression stroke of the roller progresses. Due to this, in the rotary compressor, the reliability of the compressor may be deteriorated as friction loss or side wear is further increased due to an increase of side pressure as described above.

SUMMARY

An aspect of the present disclosure is to provide a rotary compressor capable of suppressing an increase in side pressure between a vane and a vane slot into which the vane is inserted in a hinge vane type, thereby suppressing friction loss or side wear.

Furthermore, another aspect of the present disclosure is to provide a rotary compressor capable of suppressing refrigerant from remaining in a refrigerant residual space, thereby prevent refrigerant pressure in the refrigerant residual space from rising above discharge pressure.

In addition, still another aspect of the present disclosure is to provide a rotary compressor capable of allowing a refrigerant residual space to communicate with a discharge port so that refrigerant in the refrigerant residual space is discharged through the discharge port, thereby easily discharging residual refrigerant from the refrigerant residual space.

Particular implementations of the present disclosure described herein provide a rotary compressor that includes a cylinder, a roller, a vane, and a bearing plate. The cylinder may include a discharge guide groove and a vane slot. The discharge guide groove may be disposed at a side of the vane slot. The roller may be configured to orbit in the cylinder and include a hinge groove. The vane may have a first portion and a second portion. The first portion may be inserted into the hinge groove of the roller. The second portion may be inserted into, and configured to slide along, the vane slot of the cylinder. The bearing plate may engage with an axial surface of the cylinder and define a discharge port that fluidly communicates with the discharge guide groove. The discharge port may fluidly communicate with a space defined between the vane slot and the discharge guide groove.

In some implementations, the rotary compressor may optionally include one or more of the following features. The discharge port may overlap at least partially with the vane in an axial direction. The discharge guide groove may fluidly communicate with the discharge port. The discharge port may be concentric with the discharge guide groove. An inner diameter of the discharge port may be larger than an inner diameter of the discharge guide groove. An inner diameter of the discharge port at a side opposite to the discharge guide groove may be the same as an inner diameter of the discharge guide groove. The discharge port may include a discharge port inlet portion and a discharge port outlet portion. T discharge port inlet portion may face the discharge guide groove. The discharge port outlet portion may be opposite to the discharge guide groove. An inner diameter of the discharge port inlet portion may be larger than an inner diameter of the discharge port outlet portion. The inner diameter of the discharge port inlet portion may be larger than an inner diameter of the discharge guide groove. The bearing plate may include a discharge groove defined at an inlet of the discharge port that faces the discharge guide groove. The discharge groove may extend in a radial direction toward the vane. The discharge groove may overlap with the vane in the axial direction. The discharge guide groove may fluidly communicate with the discharge port. The discharge port may be eccentrically positioned toward the vane with respect to a center of the discharge guide groove. The discharge port may extend along the axial direction. The discharge port may be inclined with respect to the axial direction. The discharge guide groove may fluidly communicate with the discharge port. The bearing plate may include a discharge passage extending between the discharge guide groove and the space. The discharge passage may include at least one of a hole or a groove that extends through between the discharge guide groove and the vane slot.

Particular implementations of the present disclosure described herein provide a rotary compressor that includes a cylinder, a roller, a vane, and a bearing plate. The cylinder may include a discharge guide groove and a vane slot. The discharge guide groove may be disposed at a side of the vane slot. The roller may be configured to orbit in the cylinder and including a hinge groove. The vane may have a first portion and a second portion. The first portion may be inserted into the hinge groove of the roller. The second portion may be inserted into, and configured to slide along, the vane slot of the cylinder. The bearing plate may engage with an axial surface of the cylinder and define a discharge port that fluidly communicates with the discharge guide groove. The discharge port may overlap at least partially with the vane slot or the hinge groove in an axial direction.

In some implementations, the rotary compressor may optionally include one or more of the following features. The discharge port may be coaxial with the discharge guide groove in the axial direction. An inner diameter of the discharge port at a side that faces the discharge guide groove may be larger than an inner diameter of the discharge guide groove. The discharge port may be disposed eccentrically toward the vane slot or the hinge groove with respect to a center of the discharge guide groove.

Particular implementations of the present disclosure described herein provide a rotary compressor that includes a cylinder, a roller, a vane, and a bearing plate. The cylinder may include a discharge guide groove and a vane slot. The discharge guide groove may be disposed at a side of the vane slot. The roller may be configured to orbit in the cylinder and including a hinge groove. The vane may have a first portion and a second portion. The first portion may be inserted into the hinge groove of the roller. The second portion may be inserted into, and configured to slide along, the vane slot of the cylinder. The bearing plate may engage with an axial surface of the cylinder and define a discharge port that fluidly communicates with the discharge guide groove. The discharge port may overlap with the vane in an axial direction.

In some implementations, the rotary compressor may optionally include one or more of the following features. The discharge port may be larger than the discharge guide groove. The discharge port may be inclined toward the vane with respect to the axial direction. The discharge port may be disposed eccentrically toward the vane with respect to the discharge guide groove. The discharge port may include two sections having different inner diameters.

In order to achieve the objectives of the present disclosure, a rotary compressor having a discharge port disposed to overlap with a vane may be provided.

Furthermore, a rotary compressor in which the discharge port is disposed wider than a discharge guide groove.

In addition, it is intended to provide a rotary compressor in which the discharge port is disposed to be inclined toward the vane.

Moreover, it is intended to provide a rotary compressor in which the discharge port is eccentrically disposed toward the vane with respect to the discharge guide groove.

Besides, it is intended to provide a rotary compressor in which the discharge port is disposed to have a double area.

In addition, in order to achieve the objectives of the present disclosure, there is provided a rotary compressor, including at least one cylinder in which a discharge guide groove is disposed at one side of a vane slot; a roller orbitably provided in the cylinder, and disposed with a hinge groove on an outer circumferential surface thereof; a vane in which one end portion thereof is rotatably inserted into the hinge groove of the roller, and the other end portion thereof is slidably inserted into the vane slot of the cylinder; and a plurality of bearing plates that seals both side surfaces of the cylinder, and at least one side of which is disposed with a discharge port to communicate with the discharge guide groove, wherein the discharge port communicates with a space disposed between one end of the discharge guide groove adjacent to the vane slot and one side surface of the vane facing the one end, and an outer circumferential surface of the roller.

Here, the discharge port may be disposed such that at least part thereof overlaps with the vane when projected in an axial direction.

Furthermore, the discharge guide groove may be disposed to communicate with the discharge port, and the center of the discharge port may be disposed to be concentric with the center of the discharge guide groove.

Furthermore, an inner diameter of the discharge port may be defined to be larger than that of the discharge guide groove.

Furthermore, an outlet-side inner diameter of the discharge port may be defined to be the same as an inner diameter of the discharge guide groove.

Furthermore, the discharge port may include a discharge port inlet portion and a discharge port outlet portion, and an inner diameter of the discharge port inlet portion may be defined to be larger than that of the discharge port outlet portion, and an inner diameter of the discharge port inlet portion facing the discharge guide groove may be defined to be larger than that of the discharge guide groove.

Furthermore, a discharge groove extending eccentrically in a radial direction toward the vane may be disposed at an inlet of the discharge port facing the discharge guide groove, and the discharge groove may be disposed to overlap with the vane when projected in an axial direction.

Furthermore, the discharge guide groove may be disposed to communicate with the discharge port, and the center of the discharge port may be disposed to be eccentrically positioned toward the vane with respect to the center of the discharge guide groove.

Furthermore, the discharge port may be disposed in parallel to an axial direction.

Furthermore, the discharge port may be disposed to be inclined with respect to an axial direction.

Here, the discharge guide groove may be disposed to communicate with the discharge port, and a discharge passage may be disposed between the discharge guide groove and the space.

Furthermore, the discharge passage may include a hole or a groove passing through between the discharge guide groove and the vane slot.

In addition, in order to achieve the objectives of the present disclosure, there is provided a rotary compressor, including at least one cylinder in which a discharge guide groove is disposed at one side of a vane slot; a roller orbitably provided in the cylinder, and disposed with a hinge groove on an outer circumferential surface thereof; a vane in which one end portion thereof is rotatably inserted into the hinge groove of the roller, and the other end portion thereof is slidably inserted into the vane slot of the cylinder; and a plurality of bearing plates that seals both side surfaces of the cylinder, and at least one side of which is disposed with a discharge port to communicate with the discharge guide groove, wherein at least part of the discharge port is disposed to overlap with the vane slot or the hinge groove when projected in an axial direction.

Here, the center of the discharge port may be disposed to coincide with the center of the discharge guide groove in an axial direction, and an inlet-side inner diameter of the discharge port facing the discharge guide groove may be defined to be larger than an inner diameter of the discharge guide groove.

Here, the center of the discharge port may be disposed eccentrically toward the vane slot or the hinge groove with respect to the center of the discharge guide groove.

DETAILED DESCRIPTION

Hereinafter, a rotary compressor according to the present embodiment will be described in detail with reference to an embodiment illustrated in the accompanying drawings. The rotary compressor according to the present embodiment may be classified into a single rotary compressor or a double rotary compressor according to the number of cylinders. The present embodiment relates to an axial side shape of a roller or a bearing plate facing the roller in a hinge vane type rotary compressor in which the roller and a vane are coupled to each other. Therefore, the present disclosure may be applied to both a single rotary compressor or a double rotary compressor. Hereinafter, a single rotary compressor will be described as an example, but the same description may also be applicable to a double rotary compressor.

Figure 1:
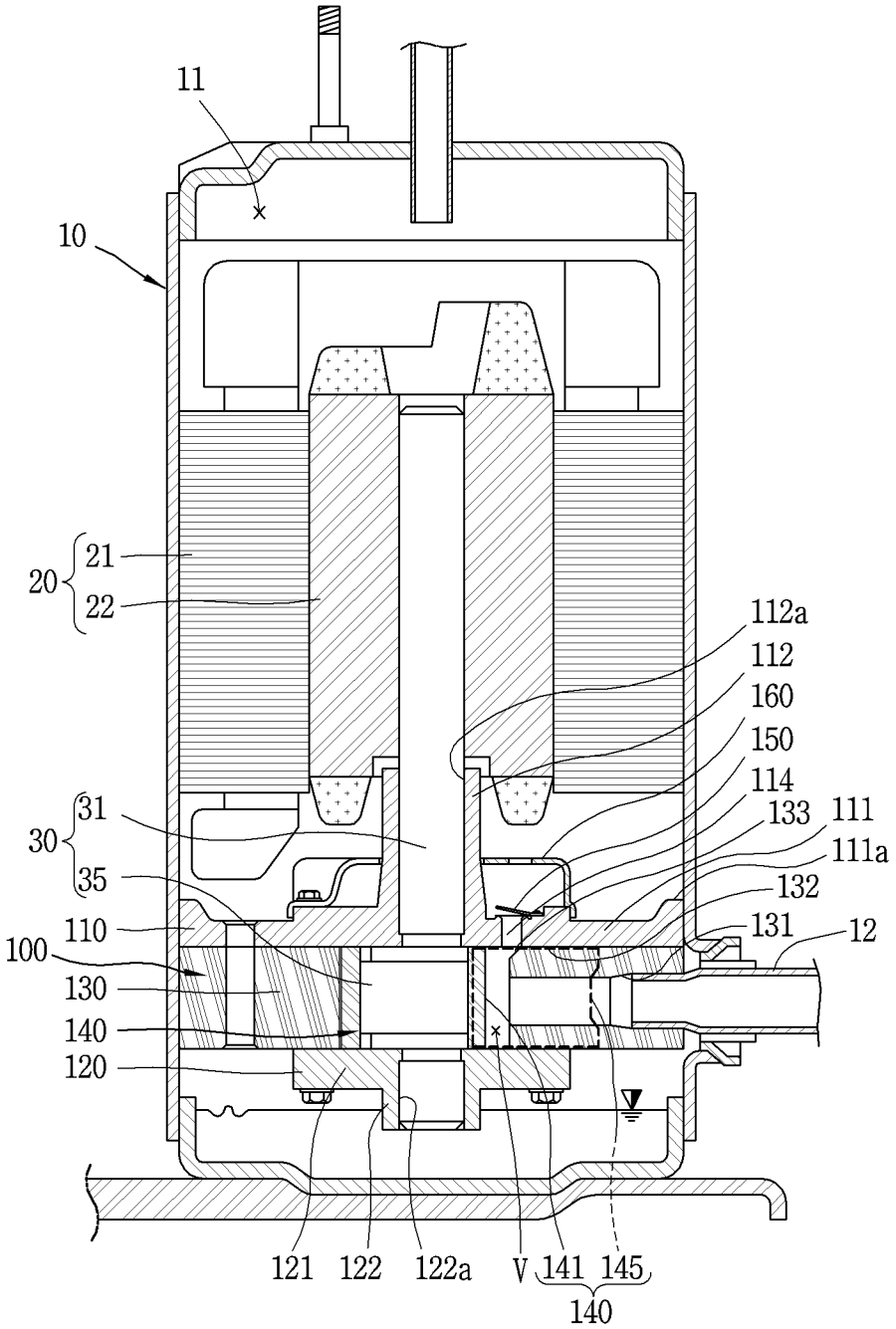
FIG. 1 is a longitudinal cross-sectional view showing a rotary compressor according to the present embodiment.
Figure 2:
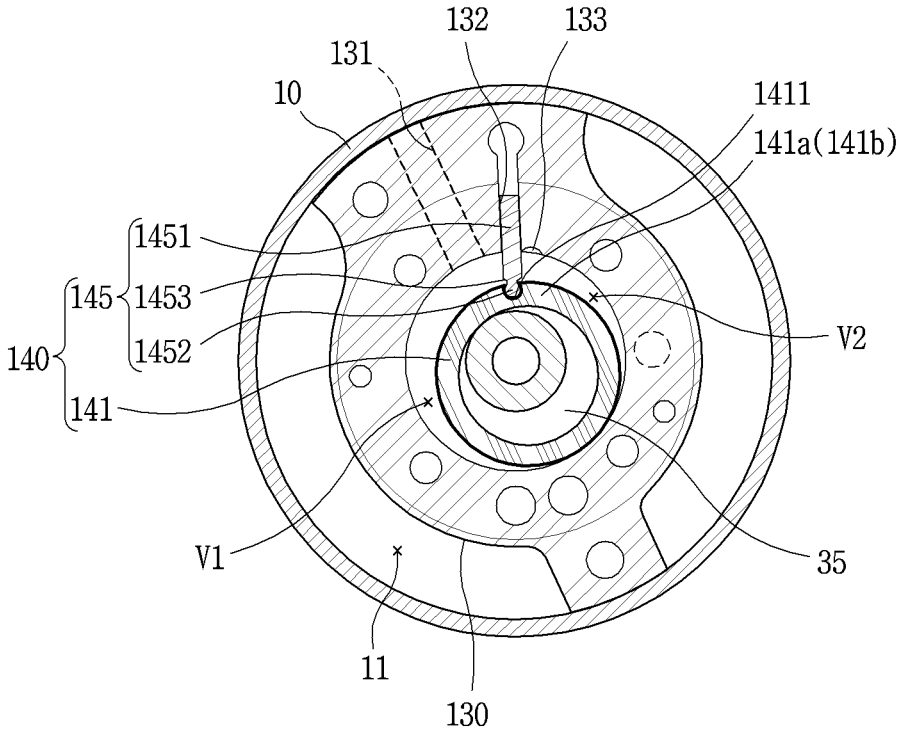
FIG. 2 is a transverse cross-sectional view showing a compression unit in the rotary compressor according to FIG. 1.

FIG. 1 is a longitudinal cross-sectional view showing a rotary compressor according to the present embodiment, and FIG. 2 is a transverse cross-sectional view showing a compression unit in the rotary compressor according to FIG. 1.

Referring to FIGS. 1 and 2, in the rotary compressor according to the present embodiment, an electric motor unit 20 is provided in an inner space 11 of a casing 10, and a compression unit 100 mechanically connected by a rotary shaft 30 is provided in the inner space 11 of the casing 10 at a lower side of the electric motor unit 20.

The electric motor unit 20 includes a stator 21 press-fitted and fixed to an inner circumferential surface of the casing 10 and a rotor 22 rotatably inserted into the stator 21. The rotary shaft 30 is press-fitted and coupled to the rotor 22. An eccentric portion 35 is disposed eccentrically with respect to a shaft portion 31 in the rotary shaft 30, and a roller 141 of a vane roller 140 which will be described later is slidably coupled to the eccentric portion 35.

The compression unit 100 includes a main bearing plate 110, a sub bearing plate 120, a cylinder 130, and a vane roller 140. The main bearing plate 110 and the sub bearing plate 120 are provided at both axial sides with the cylinder 130 interposed therebetween to define a compression space (V) inside the cylinder 130. In addition, the main bearing plate 110 and the sub bearing plate 120 support the rotary shaft 30 passing through the cylinder 130 in a radial direction. The vane roller 140 is coupled to the eccentric portion 35 of the rotary shaft 30 to compress refrigerant while performing an orbiting movement in the cylinder 130.

In the main bearing plate 110, a main flange portion 111 is disposed in a disc shape, and a sidewall portion 111*a* is disposed at an edge of the main flange portion 111 to be shrink-fitted or welded to an inner circumferential surface of the casing 10. A main bearing portion 112 is disposed at the center of the main flange portion 111 to protrude upward, and a main shaft receiving hole 113 is disposed at the main bearing portion 112 to pass therethrough such that the rotary shaft 30 is inserted and supported thereto.

A discharge port 114 in communication with the compression space (V) to discharge refrigerant compressed in the compression space (V) to the inner space 11 of the casing 10 is disposed at one side of the main bearing portion 112. In some cases, the discharge port 114 may be disposed in the sub bearing plate 120 other than the main bearing plate 110. The discharge port 114 will be described later.

In the sub bearing plate 120, the sub flange portion 121 may be defined in a disc shape and bolt-fastened to the main bearing plate 110 together with the cylinder 130. Of course, when the cylinder 130 is fixed to the casing 10, the main bearing plate 110 may be bolt-fastened to the cylinder 130 and the sub bearing plate 120, respectively, and when the sub bearing plate 120 fixed to the casing 10, the cylinder 130 and the main bearing plate 110 may be fastened to the sub bearing plate 120 with bolts.

A sub bearing portion 122 is disposed at the center of the sub flange portion 121 to protrude downward, and a sub shaft receiving hole 122*a* is disposed at the sub bearing portion 122 to pass therethrough on the same axial line as a main shaft receiving hole 112*a*. A lower end of the rotary shaft 30 is supported by the sub shaft receiving hole 122*a*.

The cylinder 130 is defined in a circular annular shape with the same inner diameter on an inner circumferential surface thereof. An inner diameter of the cylinder 130 is defined to be larger than an outer diameter of the roller 141 to define a compression space (V) between an inner circumferential surface of the cylinder 130 and an outer circumferential surface of the roller 141. Accordingly, the inner circumferential surface of the cylinder 130, the outer circumferential surface of the roller 141, and the vane 145 may define an outer wall surface of the compression space (V), an inner wall surface of the compression space (V), and a side wall surface of the compression space (V), respectively. Therefore, as the roller 141 performs an orbiting movement, the outer wall surface of the compression space (V) may define a fixed wall while the inner wall surface and the side wall surface of the compression space (V) define a variable wall whose position is variable.

A suction portion 131 is disposed in the cylinder 130, and a vane slot 132 is disposed at one circumferential side of the suction portion 131, and a discharge guide groove 133 is disposed at an opposite side of the suction portion 131 with the vane slot 132 interposed therebetween.

The suction port 131 is defined in a circular cross-sectional shape, and disposed to pass between an outer circumferential surface and an inner circumferential surface of the cylinder 130 and connected to a suction pipe 12 passing through the casing 10 is connected. Accordingly, refrigerant is sucked into the compression space (V) of the cylinder 130 through the suction pipe 12 and the suction port 131.

The vane slot 132 is defined in a rectangular parallelepiped cross-sectional shape, and disposed in an elongated manner in a direction from an inner circumferential surface of the cylinder 130 toward an outer circumferential surface thereof. An inner circumferential side of the vane slot 132 is open, and an outer circumferential side thereof is disposed to be open so as to be blocked by an inner circumferential surface of the casing 10.

Furthermore, the vane slot 132 is disposed to have a width approximately equal to the thickness or width of the vane 145 to allow the vanes 145 of the vane roller 140 which will be described later to slide. Accordingly, both side surfaces of the vanes 145 are supported by both inner wall surfaces of the vane slot 132 to slide approximately linearly.

The discharge guide groove 133 is defined by chamfering a hemispherical cross-sectional shape at an inner edge of the cylinder 130. The discharge guide groove 133 serves to guide refrigerant compressed in the compression space of the cylinder to the discharge port 114 of the main bearing plate 110. Accordingly, the discharge guide groove is disposed at a position overlapping with the discharge port when projected in an axial direction so as to communicate with the discharge port.

However, since the discharge guide groove 133 generates a dead volume, the discharge guide groove 133 may not be defined or may be defined with a minimum size. The discharge guide groove 133 will be described in detail later.

Meanwhile, the vane roller 140 includes a roller 141 and a vane 145 as described above. The roller 141 and the vane may be defined as a single body or may be coupled to each other to allow relative movement. The present embodiment will be described based on an example in which the roller and the vane are rotatably coupled to each other.

The roller 141 is defined in a cylindrical shape. An axial height of the roller 141 is defined substantially the same as an inner circumferential height of the cylinder 130. However, since the roller 141 must slide relative to the main bearing plate 110 and the sub bearing plate 120, the axial height of the roller 141 may be disposed to be slightly smaller than the inner circumferential height of the cylinder 130.

Furthermore, the inner circumferential height and the outer circumferential height of the roller 141 may be disposed to be substantially the same. Accordingly, both axial cross-sections connecting between the inner circumferential surface and the outer circumferential surface of the roller 141 define a first sealing surface 141*a* and a second sealing surface 141*b*, and the first sealing surface 141*a* and the second sealing surface 141*b* are perpendicular to the inner or outer circumferential surface of the roller 141. However, an edge between an inner circumferential surface of the roller 141 and the sealing surfaces 141*a*, 141*b* or an edge between an outer circumferential surface of the roller 141 and the sealing surfaces 141*a*, 141*b* may be defined at a right angle or may be slightly inclined or curved.

The roller 141 is rotatably inserted into and coupled to the eccentric portion 35 of the rotary shaft 30, and the vane 145 is slidably coupled to the vane slot 132 of the cylinder 130 while at the same time being hinge-coupled to an outer circumferential surface of the roller 141. Accordingly, the roller 141 performs an orbiting movement inside the cylinder 130 by the eccentric portion 35 during the rotation of the rotary shaft 30, and the vane 145 reciprocates in a state of being coupled to the roller 141.

One hinge groove 1411 is disposed on an outer circumferential surface of the roller 141 so that a hinge protrusion 1452 of the vane 145 which will be described later is inserted to rotate. The hinge groove 1411 is defined in a circular arc shape in which an outer circumferential surface thereof is open.

An inner diameter of the hinge groove 1411 is defined larger than an outer diameter of the hinge protrusion 1452, but defined with a size sufficient to slide without falling out while the hinge protrusion 1452 is inserted.

Meanwhile, the vane 145 includes a sliding portion 1451, a hinge protrusion 1452, and an interference avoiding portion 1453.

The sliding portion 1451 is defined in a flat plate shape having a predetermined length and thickness. For example, the sliding portion 1451 is defined in a rectangular hexagonal shape as a whole. In addition, the sliding portion 1451 is defined by a length such that the vane 145 remains in the vane slot 132 even when the roller 141 is completely moved to an opposite side of the vane slot 132.

The hinge protrusion 1452 is disposed to extend to a front end portion of the sliding portion 1451 facing the roller 141. The hinge protrusion 1452 is inserted into the hinge groove 1411 and disposed to have a rotatable cross-sectional area. The hinge protrusion 1452 may be defined in a substantially circular cross-sectional shape except for a semicircular or connecting portion to correspond to the hinge groove 1411.

The interference avoiding portion 1453 is a portion disposed to prevent the sliding portion 1451 from interfering with an axial edge of the hinge groove 1411 when the vane 145 rotates with respect to the roller 141. Accordingly, the interference avoiding portion 1453 is disposed in a direction in which an area between the sliding portion 1451 and the hinge protrusion 1452 decreases.

The interference avoiding portion 1453 is typically disposed to be symmetrical with respect to a longitudinal center line of the sliding portion 1451, and defined in a recessed wedge curved cross-sectional shape. Accordingly, the interference avoiding portion 1453 is spaced apart by a predetermined distance from an inner wall surface of the vane slot 132 while being inserted into the vane slot 132 to define an outer circumferential surface of the roller 141 and the refrigerant residual space (S) which will be described later.

Reference numerals 150 and 160 on the drawing denote a discharge valve and a muffler, respectively.

The foregoing rotary compressor according to the present embodiment operates as follows.

In other words, when power is applied to the electric motor unit 20, the rotor 22 of the electric motor unit 20 is rotated to rotate the rotary shaft 30. Then, the roller 141 of the vane roller 140 coupled to the eccentric portion 35 of the rotary shaft 30 rotates to suck refrigerant into the compression space (V) of the cylinder 130.

The refrigerant repeats a series of processes of being compressed by the roller 141 and the vane 145 of the vane roller 140, opening a discharge valve 150 provided in the main bearing plate 110 to be discharged into an inner space of the muffler 160 through the discharge port 114, and being discharged into the inner space 11 of the casing 10.

Figure 3:
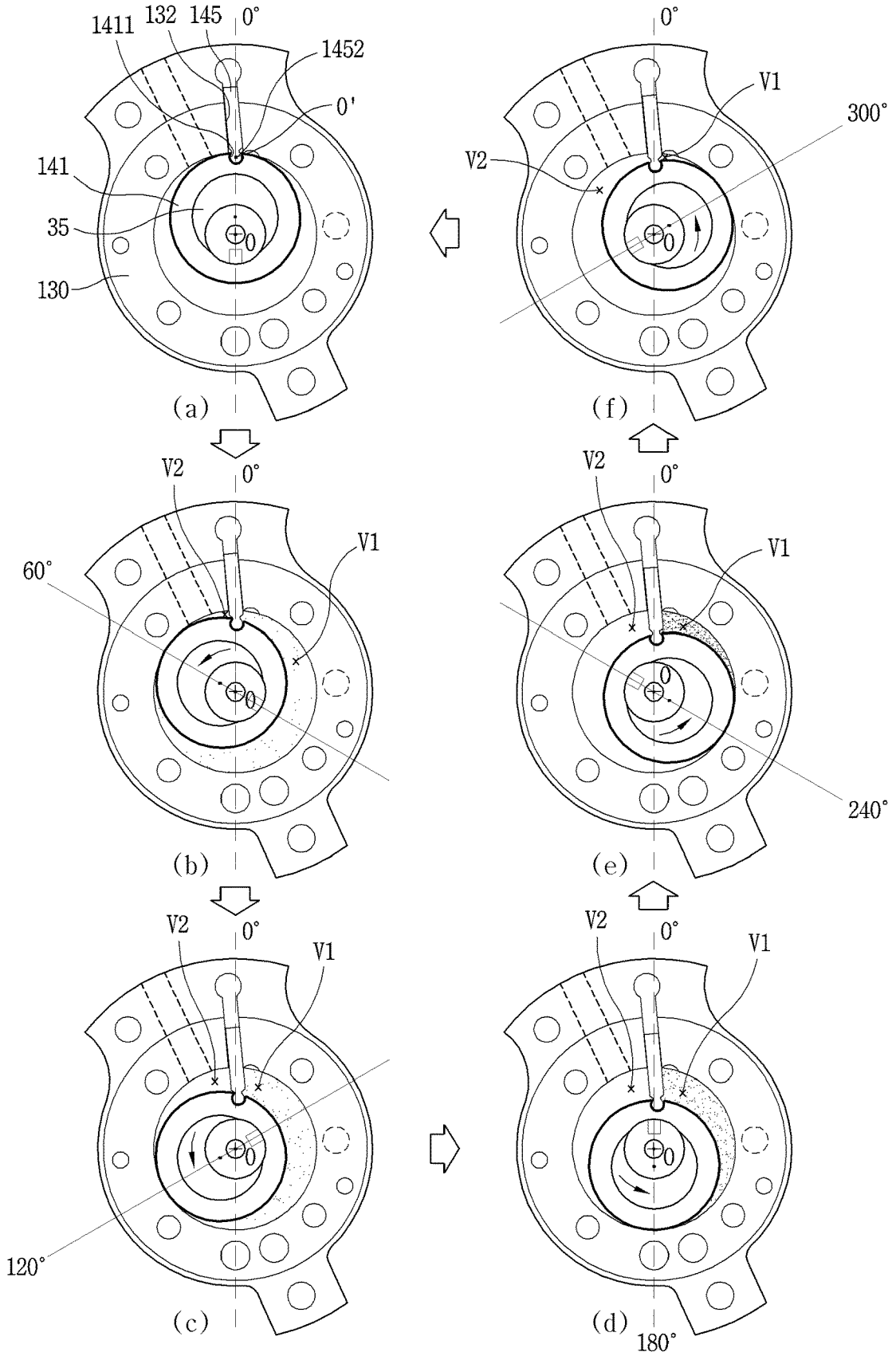
FIG. 3 is a schematic view showing a positional change of a vane roller with respect to a rotation angle of a rotary shaft in a rotary compressor according to the present embodiment.

At this time, the position of the roller 141 and the vane 145 is moved according to an rotation angle of the rotary shaft 30. FIG. 3 is a schematic view showing a positional change of a vane roller with respect to a rotation angle of a rotary shaft in a rotary compressor according to the present.

First, in this drawing, an imaginary line (hereinafter, referred to as a first center line) passing through an axial center (O) of the rotary shaft 30 (the same as an axial center of the cylinder) and an axial center (O') of the hinge groove 1411 at a position where the eccentric portion 35 of the rotary shaft 30 faces the vane slot 132 is referred to as 0°. This corresponds to (a) of FIG. 3. At this time, the hinge groove 1411 of the roller 141 is almost in contact with an inner circumferential surface of the cylinder 130 so that the vane 145 is drawn into the vane slot 132.

Next, (b) and (c) of FIG. 3 are states in which the rotary shaft is rotated about 60° and 120°, respectively. While the state is changed from (a) of FIG. 3 to (b) and (c) of FIG. 3, the hinge groove 1411 of the roller 141 is spaced apart from an inner circumferential surface of the cylinder 130, and part of the vane 145 is withdrawn from a vane slot 132. At this time, a post-compression chamber (V2) defines a suction chamber while refrigerant flows into the post-compression chamber (V2) through the suction port 131. In contrast, a pre-compression chamber (V1) starts to compress refrigerant filled in the pre-compression chamber (V1) while forming the compression chamber. Since refrigerant contained in the pre-compression chamber (V1) has not yet reached the discharge pressure, a gas force or vane reaction force is not generated or negligible in the pre-compression chamber even when generated.

Next, (d) of FIG. 3 is a state in which the rotary shaft is rotated about 180°. While the state is changed from (c) of FIG. 3 to (d) of FIG. 3, the hinge groove 1411 of the roller 141 is spaced to the maximum apart from an inner circumferential surface of the cylinder 130, and the vane 145 is withdrawn to the maximum from the vane slot 132. Since the pre-compression chamber (V1) is in a state where the compression stroke is substantially advanced, refrigerant contained in the pre-compression chamber (V1) is close to the discharge pressure. Then, in the pre-compression chamber (V1), a gas force and a roller reaction force are generated by refrigerant to be compressed, and the gas force and roller reaction force are transmitted to the vane 145. A reaction force is generated in a width direction of the vane 145 between both sides of the vane 145 and an inner surface of the vane slot 132 by the gas force and the roller reaction force transmitted to the vane 145. This reaction force may cause an increase in side pressure or side wear between the vane 145 and the vane slot 132. This will be described later along with an avoidance structure against an increase in side pressure or side wear.

Next, (e) of FIG. 3 illustrates a state in which the rotary shaft is rotated about 240 degrees. In this state, the hinge groove 1411 of the roller 141 moves back toward an inner circumferential surface of the cylinder 130, and the vane 145 is partially withdrawn into the vane slot 132. At this time, the refrigerant contained in the pre-compression chamber (V1) has already reached a discharge pressure to start discharging or has reached a discharge start point. Therefore, in this state, the gas force and the roller reaction force described above are at or near the maximum, and thus an increase in side pressure or side wear between the vane 145 or the vane slot 132 may be generated to the greatest extent. This will be also described later along with an avoidance structure against an increase in side pressure or side wear.

Next, (f) of FIG. 3 is a state in which the rotary shaft is rotated about 300 degrees. In this state, refrigerant in the pre-compression chamber (V1) is almost discharged, and the hinge groove 1411 of the roller 141 is almost in contact with an inner circumferential surface of the cylinder 130, and the vane 145 is almost withdrawn into the vane slot 132. In this state, almost no refrigerant remains in the pre-compression chamber (V1), and thus the gas force and roller reaction force are hardly generated.

As described above, in the rotary compressor, the gas force and roller reaction force act on the vane 145 at the same time due to the characteristics thereof. The gas force acts in a width direction of the vane 145, which is a direction from the pre-compression chamber (discharge chamber) to the post-compression chamber (suction chamber), and the roller reaction force acts in a direction toward the vane 145 or acts as a component force to the force acting toward the vane 145 depending on the position of the roller 141.

Accordingly, in the rotary compressor, as the gas force and roller reaction force are transmitted to a front side of the vane 145, a first reaction force and a second reaction force acting in opposite directions are generated between both side surfaces of the vane 145 and around an inner circumferential edge and around an outer circumferential edge of the vane slot 132 facing the both side surfaces of the vane 145.

As a result, when the vane 145 reciprocates inside the vane slot 132 during the aforementioned compression process, side pressure may be increased while both side surfaces of the vane 145 and the side surface edges of the vane slot 132 facing the vane 145 are excessively in close contact with each other, thereby causing friction loss or side wear.

Meanwhile, in the rotary compressor, a refrigerant residual space may be defined between a side surface of the discharge side of the vane, one end of the discharge guide groove, and an outer circumferential surface of the roller, and the refrigerant residual space may be sealed while refrigerant remains. Then, refrigerant in the refrigerant residual space is further compressed along an orbiting movement of the roller so that refrigerant pressure rises above a discharge pressure.

At this time, in a rolling piston type rotary compressor, since the vane is not constrained by the roller, if the pressure in the refrigerant residual space rises excessively, the vane is separated from the roller, and the refrigerant in the refrigerant residual space leaks to the opposite space (suction chamber) of the vane. It can lower the pressure in the refrigerant residual space.

However, in the hinge vane type rotary compressor, as the vane is constrained to the roller, refrigerant in the refrigerant residual space rises above the discharge pressure as described above without being leaked. Then, refrigerant pressure in the refrigerant residual space may be added to further increase a side pressure on the vane and the vane slot, thereby increasing friction loss or side wear between the vane and the vane slot as well as deteriorating the reliability of the vane and roller.

Accordingly, the present embodiment is intended to suppress an excessive increase in the pressure of the refrigerant residual space by defining a refrigerant discharge passage so that the refrigerant residual space communicates with the discharge port.

Figure 4:
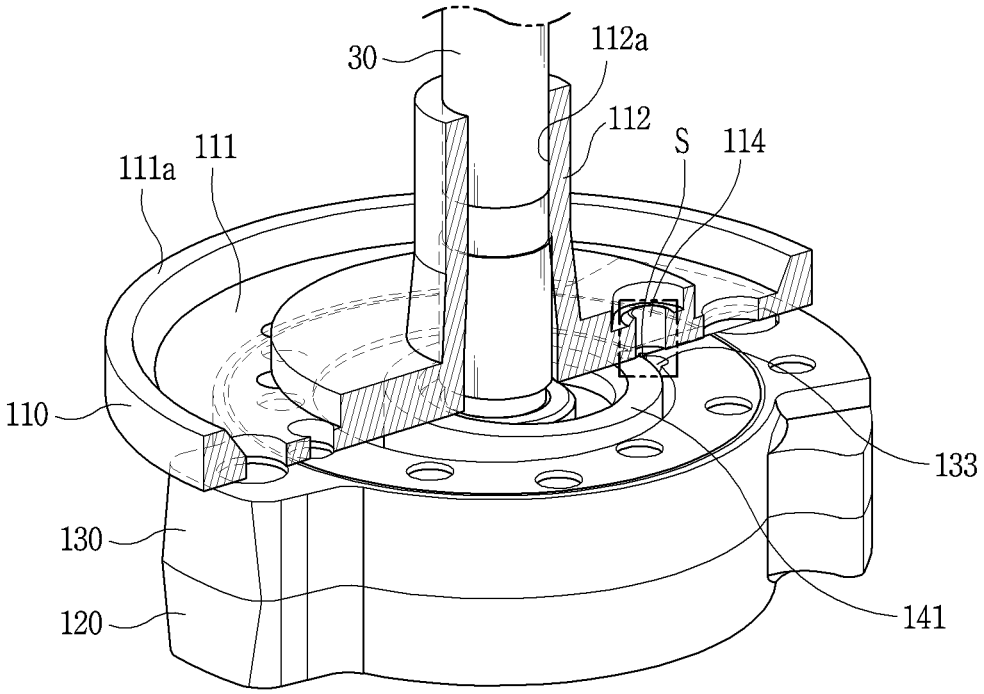
FIG. 4 is a cutaway perspective view showing part of a compression unit according to the present embodiment.
Figure 5:
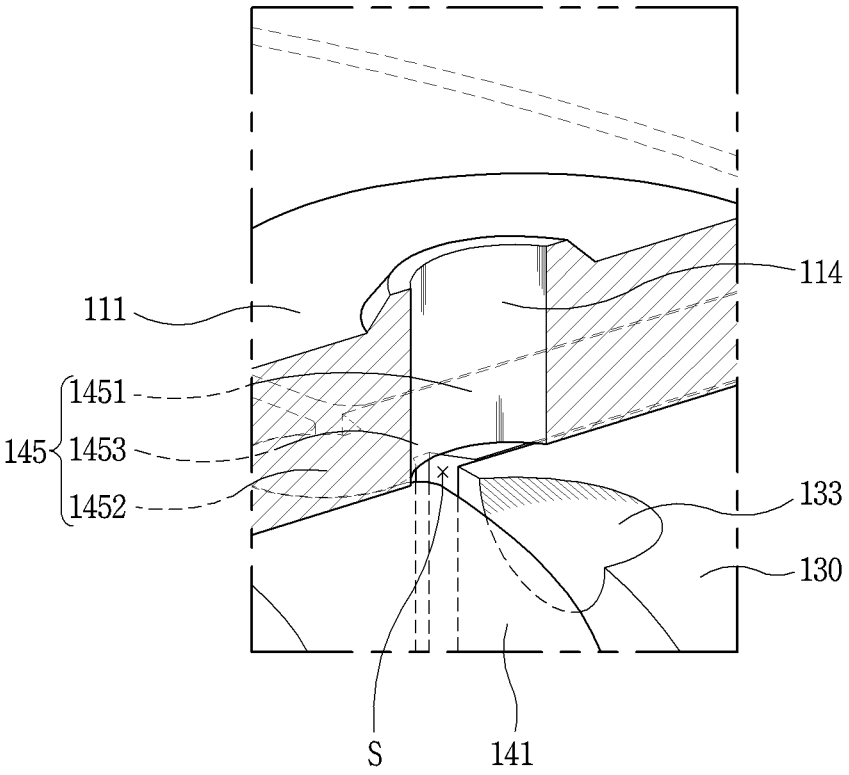
FIG. 5 is an enlarged perspective view showing the vicinity of a discharge port in FIG. 4.
Figure 6:
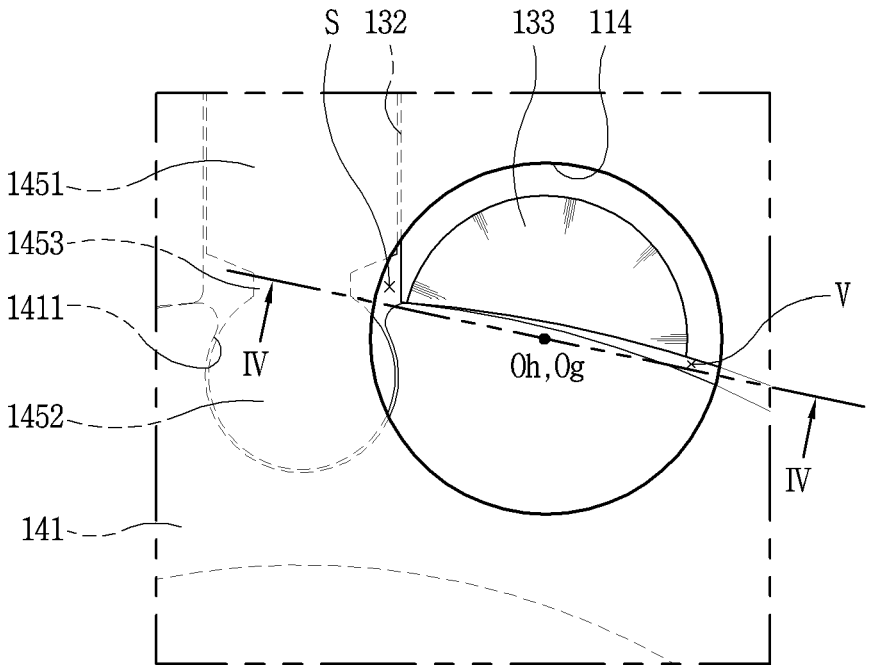
FIG. 6 is a plan view showing an example of a discharge port according to the present embodiment.
Figure 7:
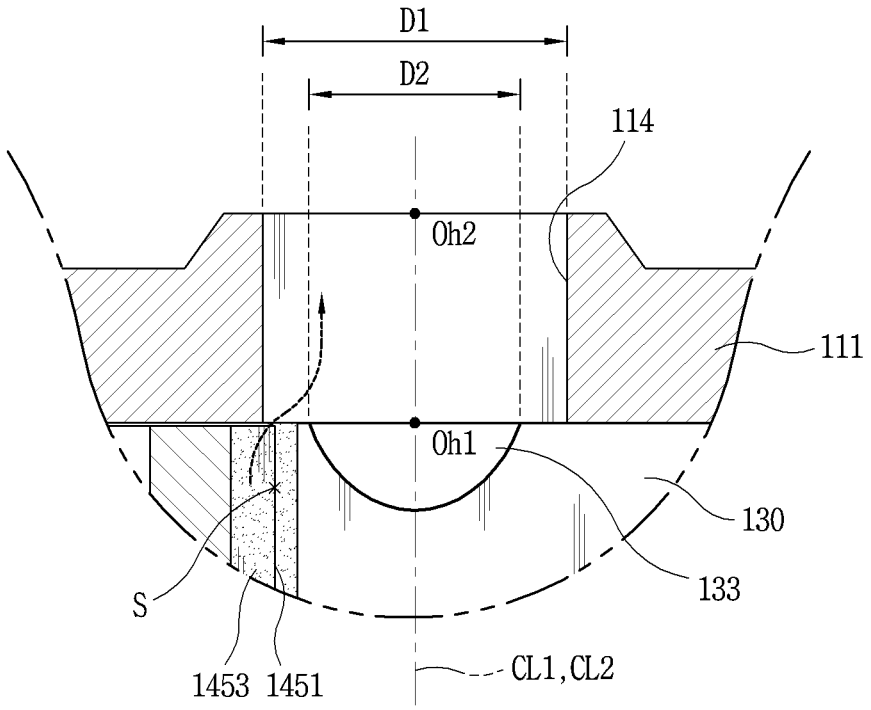
FIG. 7 is a cross-sectional view taken along line "IV-IV" in FIG. 6.

FIG. 4 is a cutaway perspective view showing part of a compression unit according to the present embodiment, and FIG. 5 is an enlarged perspective view showing the vicinity of a discharge port in FIG. 4, and FIG. 6 is a plan view showing an example of a discharge port according to the present embodiment, and FIG. 7 is a cross-sectional view taken along line "IV-IV" in FIG. 6.

Referring FIGS. 4 through 7, the discharge guide groove 133 communicating with the compression chamber (V) is disposed in the cylinder 130 according to the present embodiment, and the discharge port 114 is disposed in the main bearing plate 110 to communicate with the discharge guide groove 133. Hereinafter, the discharge port 114 defines a side facing the compression chamber (V) as an inlet, and a side facing an internal space of the muffler 160 as an outlet, respectively.

The discharge port 114 may be disposed in parallel to an axial direction of the rotary shaft 30. In other words, a first virtual line (CL1) connecting an inlet center (Oh1) and an outlet center (Oh2) of the discharge port 114 is disposed in parallel to an axial center line passing through the center (O) of the rotary shaft 30. However, in some cases, in the discharge port 114, the first virtual line (CL1) passing through the center (Oh) may be disposed to be inclined with respect to an axial center line (no reference numeral) passing through the center (O) of the rotary shaft 30.

In addition, the first virtual line (CL1) passing through the center (Oh) of the discharge port 114 may be disposed on the same line as a second virtual line (CL2) passing through the center (Og) of the discharge guide groove 133, which will be described later.

The discharge guide groove 133 is defined in a substantially hemispherical shape (exactly, a half hemispherical shape, but defined as a hemispherical shape for convenience of description) at an inner circumferential edge of the cylinder 130, and the discharge port 114 is defined in a circular shape on the main bearing plate 110.

In the discharge port 114 according to this embodiment, the center (Oh) of the discharge port 114 is disposed on the same axis as the center (Og) of the discharge guide groove 133, and an inner diameter (D1) of the discharge port 114 is defined to be larger than an inner diameter (D2) of the discharge guide groove 133, that is, a diameter of a virtual circle connecting both ends of the discharge guide groove 133 (hereinafter, defined as an inner diameter of the discharge guide groove for convenience of description though it is a curvature). In other words, a cross-sectional area of the discharge port 114 according to the present embodiment is defined to be larger than that of a virtual circle constituting the discharge guide groove 133.

Accordingly, the discharge port 114 is disposed to radially overlap with part of the hinge protrusion 1452 of the vane 145 or the hinge groove 1411 of the roller 141. Then, when projected in an axial direction, at least part of the refrigerant residual space (S) is included in a range of the discharge port 114 while the discharge port 114 and the refrigerant residual space (S) overlap with each other.

As described above, when an inner diameter (D1) of the discharge port 114 is defined to be larger than an inner diameter (D2) of the discharge guide groove 133, and the refrigerant residual space (S) (or part of the hinge protrusion and the hinge groove) overlaps within a range of the discharge port 114, the refrigerant residual space (S) remains in communication with the discharge port 114 even though the roller 141 (exactly, a contact point where the roller and the cylinder are in contact with each other) completely passes through the discharge guide groove 133. Then, a residual refrigerant discharge passage through which the refrigerant remaining in the refrigerant residual space (S) can be discharged may be defined.

Then, even when the discharge stroke of the roller 141 is completed in the corresponding compression chamber (hereinafter, for convenience of description, it is defined as a state that the roller has completed the discharge stroke), refrigerant remaining in the refrigerant residual space (S) may be discharged to an internal space of the casing 10 through the discharge port 114, thereby suppressing the pressure of the refrigerant residual space (S) from being excessively increased.

Then, side pressure applied to the vane 145 may be suppressed from being increased by a pressure of the refrigerant residual space of the roller 141, thereby preventing friction loss and side wear occurring between the vane 145 and the vane slot 132. In addition, it may be possible to suppress the reliability of the vane 145 and the roller 141 to which the vane 145 is hinge-coupled from being deteriorated.

Meanwhile, another embodiment of a residual refrigerant discharge passage in the rotary compressor according to the present disclosure will be described as follows.

In other words, in the foregoing embodiment, an inner diameter of the discharge port is enlarged to define the discharge port so as to overlap with the refrigerant residual space in an axial direction, but in the present embodiment, the discharge port is defined to overlap with the refrigerant residual space in a radial direction while maintaining the inner diameter of the discharge port.

Figure 8:
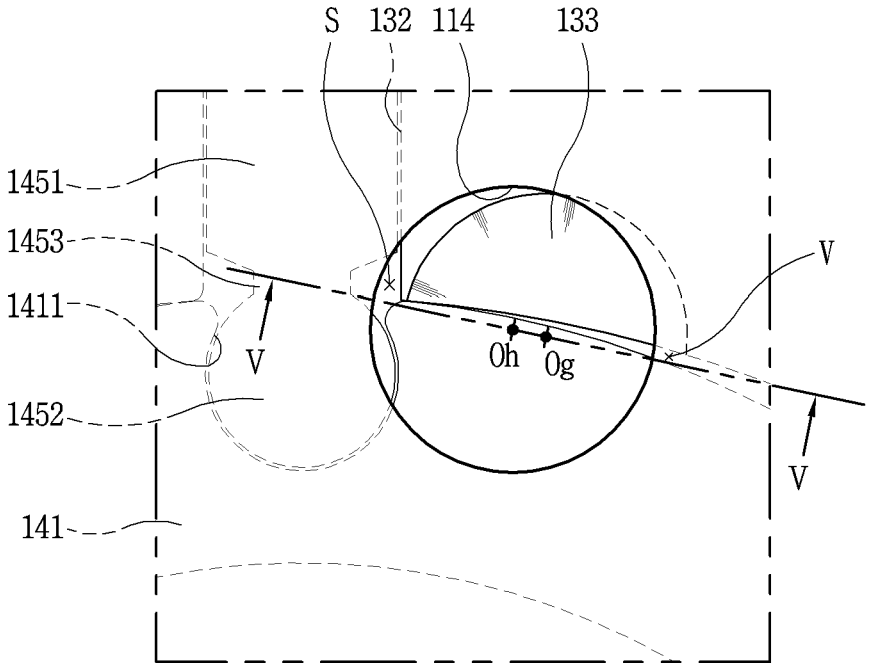
FIG. 8 is a plan view showing another example of a discharge port according to the present embodiment.
Figure 9:
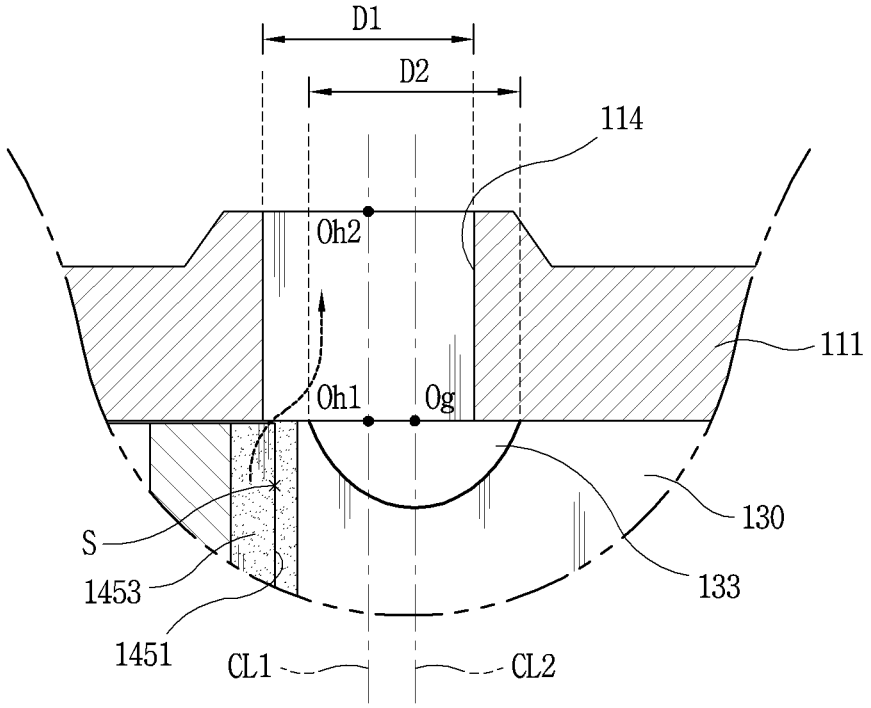
FIG. 9 is a cross-sectional view taken along line "V-V" in FIG. 8.

FIG. 8 is a plan view showing another example of a discharge port according to the present embodiment, and FIG. 9 is a cross-sectional view taken along line "V-V" in FIG. 8.

Referring to FIGS. 8 and 9, the inner diameter (D1) of the discharge port 114 may be defined substantially the same as the inner diameter (D2) of the discharge guide groove 133.

Furthermore, the discharge port 114 is disposed in parallel to an axial center line on which a first virtual line (CL1) connecting an inlet center (Oh1) and an outlet center (Oh2) of the discharge port 114 passes through the center (O) of the rotary shaft 30.

However, the center (Oh) of the discharge port 114 according to the present embodiment is not located on the same axis as the center (Og) of the discharge guide groove 133, but is disposed eccentrically toward the refrigerant residual space (S). Then, while the discharge port 114 is defined to have the same inner diameter as the discharge guide groove 133, the discharge port 114 may overlap with part of the hinge protrusion 1452 of the vane 145 or the hinge groove 1411 of the roller 141 in a radial direction.

Accordingly, when projected in an axial direction, while the discharge port 114 overlaps with the refrigerant residual space (S), at least part of the refrigerant residual space (S) is included in a range of the discharge port 114.

As described above, when the discharge port 114 is disposed eccentrically toward the refrigerant residual space (S) with respect to the discharge guide groove 133, the refrigerant residual space (S) (or part of the hinge protrusion and the hinge groove) may overlap within a range of the discharge port 114. The resultant operational effects are substantially the same as those of the above-described embodiment, and the description thereof will be omitted.

However, in the present embodiment, as the discharge port 114 is disposed by moving toward the refrigerant residual space (S), a residual refrigerant discharge passage may be defined without defining the inner diameter (D1) of the discharge port 114 to be larger than the inner diameter (D2) of the discharge guide groove 133.

Then, a size of the discharge valve 150 that opens and closes the discharge port 114 may not be enlarged, thereby maintaining the responsiveness of the valve to that extent. Through this, when the size of the discharge valve 150 is enlarged, it may be possible to suppress the responsiveness deterioration of the valve, which may occur, as well as the resultant performance degradation and noise increase of the compressor.

Meanwhile, still another embodiment of a discharge passage in the rotary compressor according to the present embodiment will be described as follows.

In other words, in the above-described embodiments, the discharge port is disposed in parallel to an axial direction of the rotary shaft, but in the present embodiment, the discharge port is disposed to be inclined with respect to an axial direction of the rotary shaft, while an inlet of the discharge port is disposed to overlap with the refrigerant residual space in a radial direction.

Figure 10:
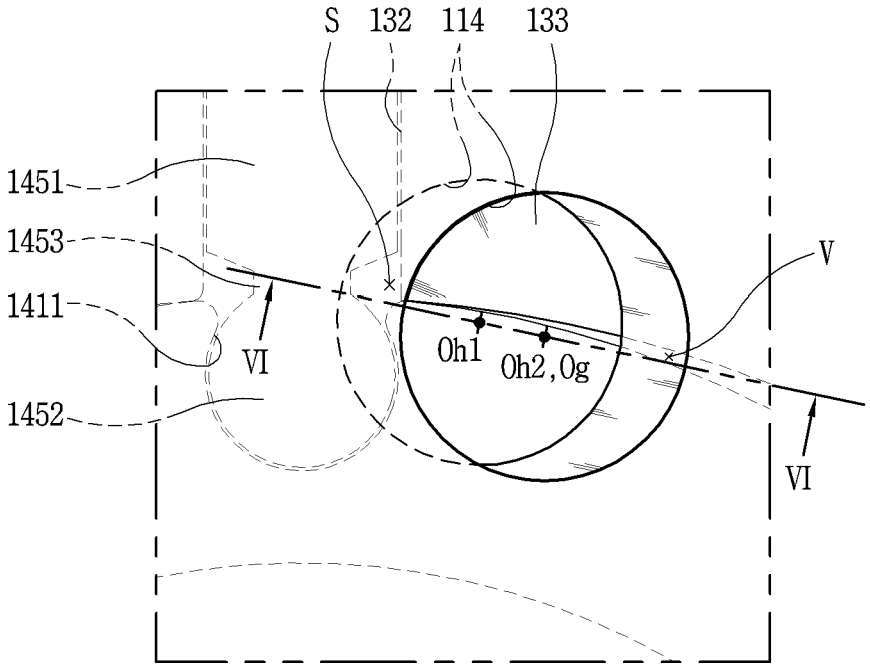
FIG. 10 is a plan view showing another example of a discharge port according to the present embodiment.
Figure 11:
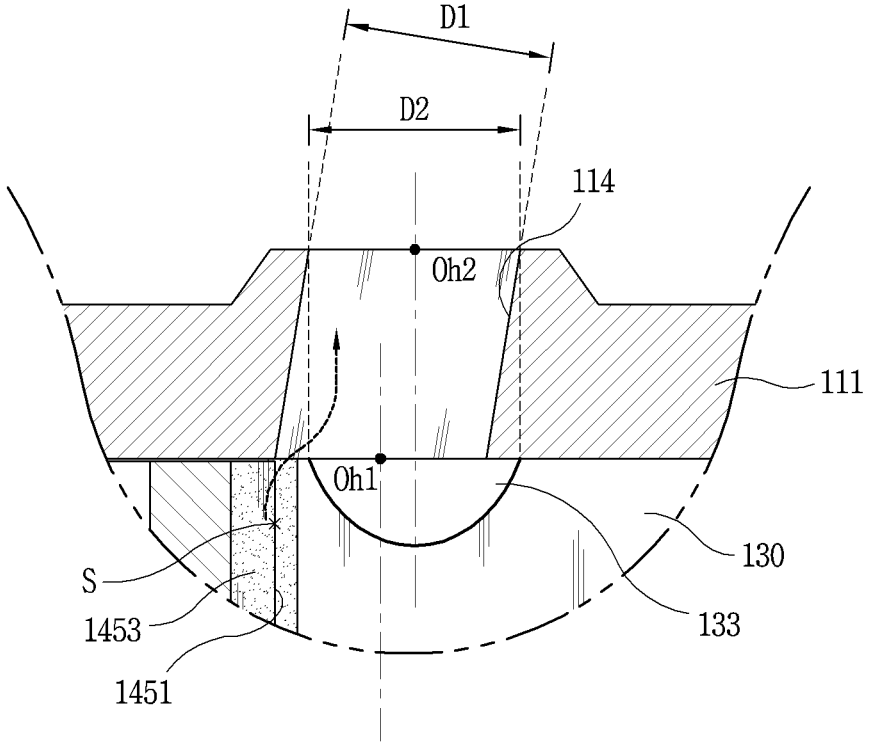
FIG. 11 is a cross-sectional view taken along line "VI-VI" in FIG. 10.

FIG. 10 is a plan view showing another example of a discharge port according to the present embodiment, and FIG. 11 is a cross-sectional view taken along line "VI-VI" in FIG. 10.

Referring to FIGS. 10 and 11, the inner diameter (D1) of the discharge port 114 according to the present embodiment is defined substantially the same as the inner diameter (D2) of the discharge guide groove 133. However, a first virtual line (CL1) connecting an inlet center (Oh1) and an outlet center (Oh2) of the discharge port 114 is disposed to be inclined with respect to an axial center line (no reference numeral) passing through the center (O) of the rotary shaft 30.

For example, the inlet center (Oh1) of the discharge port 114 is disposed eccentrically toward the vane slot 132 with respect to the center (Og) of the discharge guide groove 133. Then, even though the outlet of the discharge port 114 is spaced apart from the refrigerant residual space in a radial direction, the inlet of the discharge port 114 may overlap with part of the hinge protrusion 1452 of the vane 145 or the hinge groove 1411 of the roller 141. Accordingly, when projected in an axial direction, while the discharge port 114 overlaps with the refrigerant residual space (S), at least part of the refrigerant residual space (S) is included in a range of the discharge port 114.

In this case, the outlet center (Oh2) of the discharge port 114 may be disposed to be positioned on substantially the same axis as the center (Og) of the discharge guide groove 133.

As described above, when the inlet center (Oh1) of the discharge port 114 is disposed eccentrically toward the refrigerant residual space (S) with respect to the discharge guide groove 133, a refrigerant residual space (S) (or part of the hinge protrusion and the hinge groove) is included in a range of the discharge port 114 as in the above-described embodiments to define a residual refrigerant discharge passage.

However, in the present embodiment, as the inlet of the discharge port 114 is disposed by moving toward the refrigerant residual space (S), a residual refrigerant discharge passage may be defined without defining the inner diameter of the discharge port 114 to be larger than the inner diameter of the discharge guide groove 133.

Then, a size of the discharge valve 150 that opens and closes the discharge port 114 may not be enlarged, thereby maintaining the responsiveness of the valve to that extent as shown in the embodiment of FIG. 8. Through this, when the size of the discharge valve 150 is enlarged, it may be possible to suppress the responsiveness deterioration of the valve, which may occur, as well as the resultant performance degradation and noise increase of the compressor.

In addition, in the present embodiment, as the discharge port 114 is disposed to be inclined, the discharge valve 150 may be disposed at its original position, that is, a position having the center on the same axis as the center of the discharge guide groove 133, thereby sufficiently securing an interference distance with respect to the main bearing portion 112. Through this, a radial thickness of the main bearing portion 112 may be secured to stably support the rotary shaft to that extent.

Meanwhile, still another embodiment of a discharge passage in the rotary compressor according to the present embodiment will be described as follows.

In other words, in the above-described embodiments, the discharge port is defined with a single inner diameter, but in the present embodiment, the discharge port is defined with a plurality of inner diameters.

Figure 12:
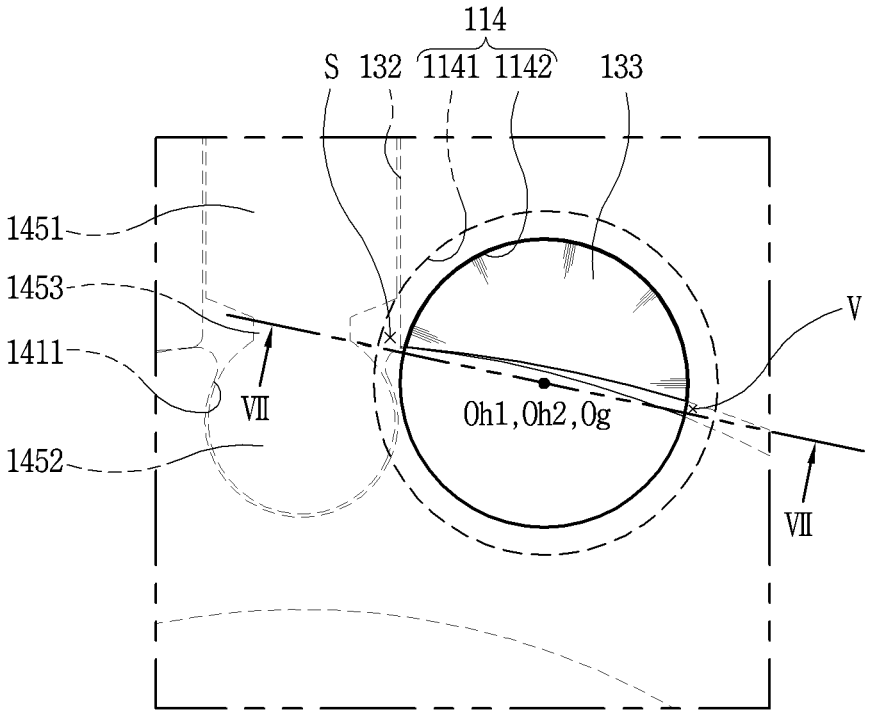
FIG. 12 is a plan view showing another example of a discharge port according to the present embodiment.
Figure 13:
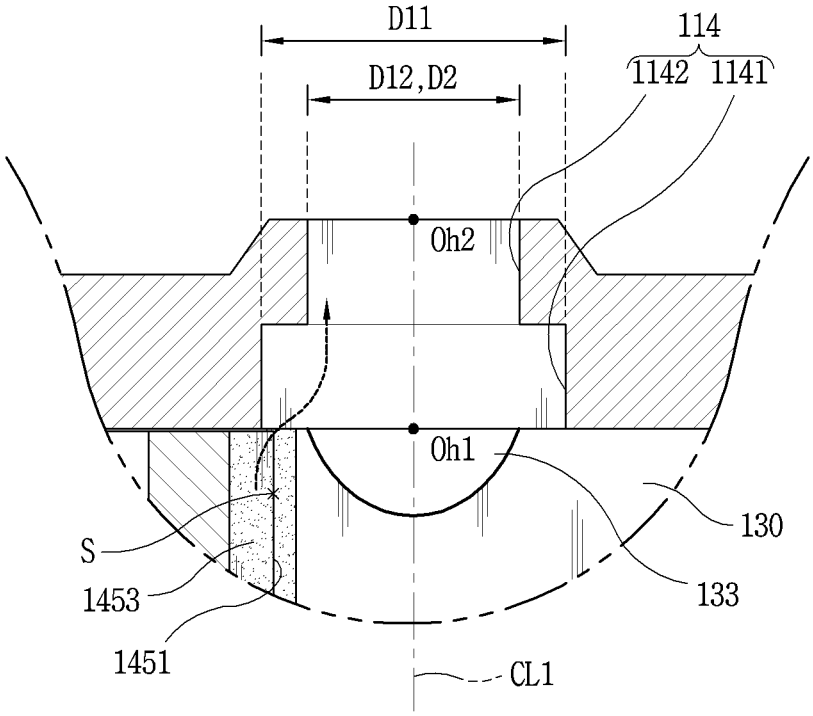
FIG. 13 is a cross-sectional view taken along line "VII-VII" in FIG. 12.

FIG. 12 is a plan view showing another example of a discharge port according to the present embodiment, and FIG. 13 is a cross-sectional view taken along line "VII-VII" in FIG. 12. Referring to FIGS. 12 and 13, a first virtual line (CL1) connecting an inlet center (Oh1) and an outlet center (Oh2) of the discharge port 114 according to the present embodiment is disposed on the same axial line with respect to an axial center line (not shown) passing through the center (O) of the rotary shaft 30.

In addition, the center (Oh) of the discharge port 114 is disposed on the same axial line as the center (Og) of the discharge guide groove 133. However, in the present embodiment, an inlet-side inner diameter (D11) of the discharge port 114 is defined to be larger than a discharge-side inner diameter (D12) thereof.

For example, the discharge port 114 according to the present embodiment is configured with a discharge port inlet portion 1141 and a discharge port outlet portion 1142 constituting an inlet side. The inner diameter (D11) of the discharge port inlet portion 1141 is defined to be larger than the inner diameter (D2) of the discharge guide groove 133, and the inner diameter (D12) of the discharge port outlet portion 1142 is defined substantially the same as the inner diameter (D2) of the discharge guide groove 133.

Then, while an outlet of the discharge port 114 is defined to have the same inner diameter as the discharge guide groove 133, an inlet of the discharge port 114 may be defined to be larger than the discharge guide groove 133 to overlap with part of the hinge protrusion 1452 of the vane 145 or the hinge groove 1411 of the roller 141 in a radial direction.

Accordingly, when projected in an axial direction, while the inlet of the discharge port 114 overlaps with the refrigerant residual space (S), at least part of the refrigerant residual space (S) is included in a range of the inlet of the discharge port 114.

As described above, when the discharge port 114 is defined with a discharge port inlet portion 1141 and a discharge port outlet portion 1142 having a double diameter, the refrigerant residual space (S) (or part the hinge protrusion and the hinge groove) may be included in a range of the inlet of the discharge port 114. The resultant operational effects are substantially the same as those of the above-described embodiment of FIG. 10, and the description thereof will be omitted.

Meanwhile, still another embodiment of a discharge passage in the rotary compressor according to the present embodiment will be described as follows.

In other words, in the above-described embodiments, the residual refrigerant discharge passage is disposed in the discharge port, but in the present embodiment, the residual refrigerant discharge groove is disposed in the discharge port.

Figure 14:
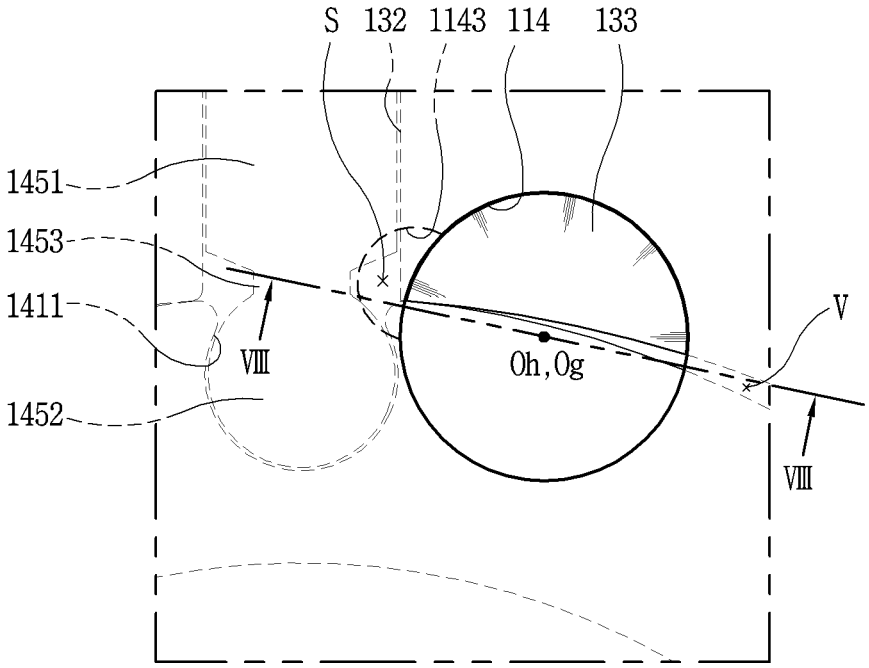
FIG. 14 is a plan view showing another example of a discharge port according to the present embodiment.
Figure 15:
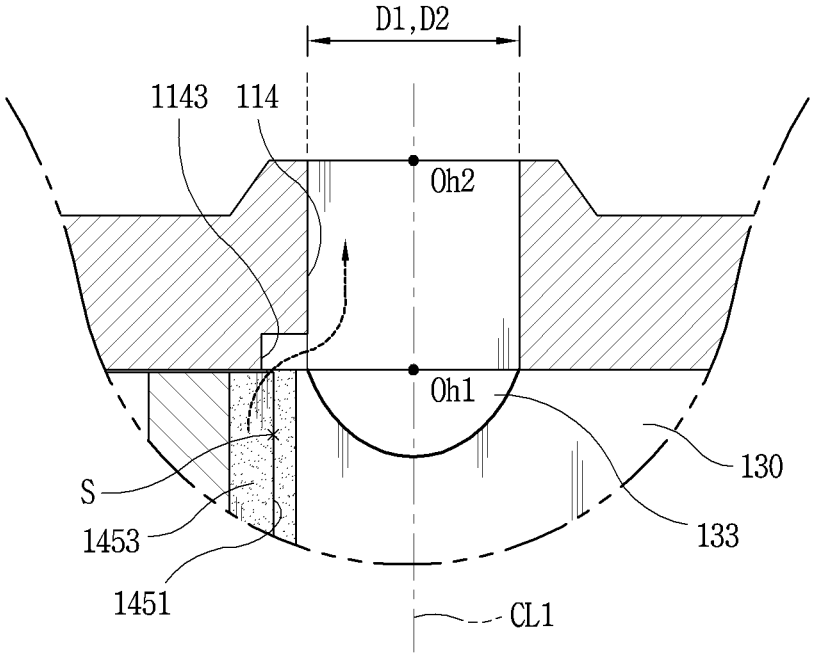
FIG. 15 is a cross-sectional view taken along line "VIII-VIII" in FIG. 14.

FIG. 14 is a plan view showing another example of a discharge port according to the present embodiment, and FIG. 15 is a cross-sectional view taken along line "VIII-VIII" in FIG. 14.

Referring to FIGS. 14 and 15, a first virtual line (CL1) connecting an inlet center (Oh1) and an outlet center (Oh2) of the discharge port 114 according to the present embodiment is disposed on the same axial line with respect to an axial center line (no reference numeral) passing through the center (O) of the rotary shaft 30.

In addition, the center (Oh) of the discharge port 114 is defined on the same axial line as the center (Og) of the discharge guide groove 133, and the inner diameter (D1) of the discharge port 114 is defined to be the same as the inner diameter (D2) of the discharge guide groove 133. However, in the present embodiment, the residual refrigerant discharge groove 1143 is disposed on an inlet side of the discharge port 114.

The residual refrigerant discharge groove 1143 is disposed to extend eccentrically toward the refrigerant residual space (S) from the inlet side of the discharge port 114. The residual refrigerant discharge groove 1143 may be defined in an arc shape or an angled shape, or may be disposed to be inclined to intersect the first virtual line (CL1) passing through the center (Oh) of the discharge port 114.

Then, while the discharge port 114 is defined to have the same inner diameter as the discharge guide groove 133, the residual refrigerant discharge groove 1143 may overlap with part of the hinge protrusion 1452 of the vane 145 or the hinge groove 1411 of the roller 141 in a radial direction.

Accordingly, when projected in an axial direction, while the residual refrigerant discharge groove 1143 provided at an inlet of the discharge port 114 overlaps with the refrigerant residual space (S), at least part of the refrigerant residual space (S) is included in a range of the inlet of the discharge port 114.

As described above, when the residual refrigerant discharge groove 1143 is disposed at the inlet of the discharge port 114, the refrigerant residual space (S) (or part the hinge protrusion and the hinge groove) may be included in a range of the inlet of the discharge port 114. The resultant operational effects are substantially the same as those of the above-described embodiment of FIG. 12, and the description thereof will be omitted.

Meanwhile, still another embodiment of a discharge passage in the rotary compressor according to the present embodiment will be described as follows.

In other words, in the above-described embodiments, the discharge port is disposed to overlap with the refrigerant residual space in a radial direction, but the present embodiment directly communicates between the discharge port and the refrigerant residual space through the discharge passage.

Figure 16:
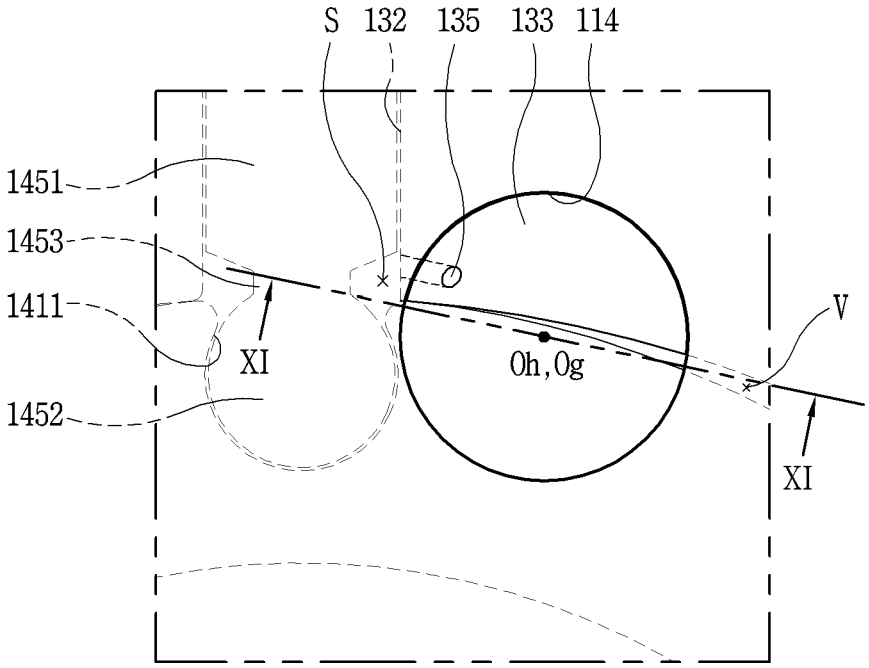
FIG. 16 is a plan view showing another example of a discharge port according to the present embodiment.
Figure 17:
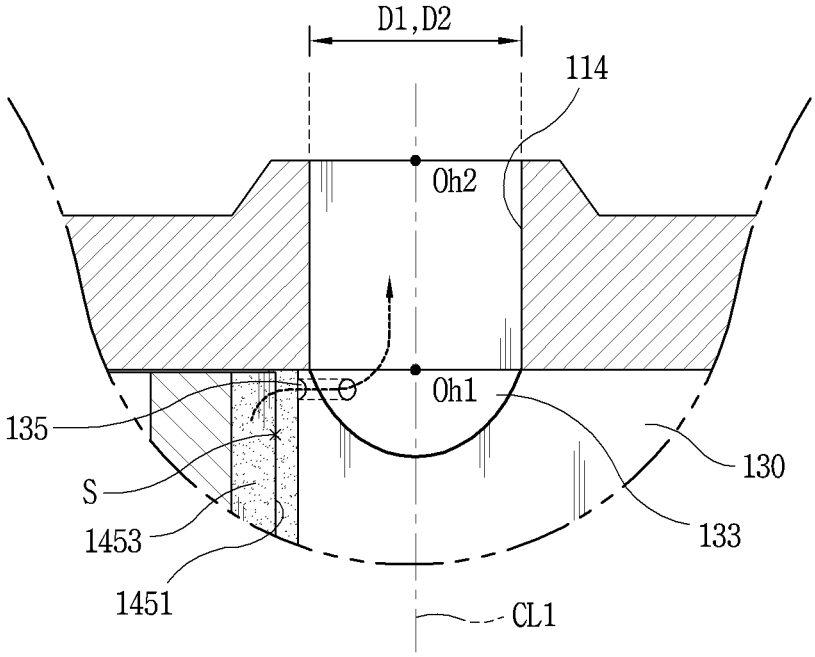
FIG. 17 is a cross-sectional view taken along line "IX-IX" in FIG. 16.

FIG. 16 is a plan view showing another example of a discharge port according to the present embodiment, and FIG. 17 is a cross-sectional view taken along line "IX-IX" in FIG. 16.

Referring to FIGS. 16 and 17, the center (Oh) of the discharge port 114 according to the present embodiment is disposed to be positioned substantially on the same axial line as the center (Og) of the discharge guide groove 133. In addition, the inner diameter (D1) of the discharge port 114 is defined substantially the same as the inner diameter (D2) of the discharge guide groove 133. Accordingly, the discharge port 114 is disposed at a position that does not overlap with the refrigerant residual space (S) in a radial direction.

However, a discharge passage 135 passing through between the inner wall surfaces of the vane slot 132 constituting the refrigerant residual space (S) may be disposed on a side surface of the discharge guide groove 133 according to the present embodiment. The discharge passage 1131 may be defined with at least one hole.

Although not shown in the drawing, the discharge passage may be defined with at least one groove provided at an edge between a side surface of the discharge guide groove and an inner wall surface of the vane slot connected at this side surface.

Here, the inlet center (Oh1) and the outlet center (Oh2) of the discharge port 114 may be disposed in parallel to or to be inclined with respect to an axial center of the rotary shaft 30.

As described above, when the discharge passage 135 is disposed between the discharge guide groove 133 and the vane slot 132, refrigerant in the refrigerant residual space (S) moves to the discharge guide groove 133 through the discharge passage 135, and the refrigerant is discharged through the discharge port 114 even when the roller 141 completely passes through the discharge guide groove 133. Accordingly, it may be possible to prevent refrigerant remaining in the refrigerant residual space (S) from being over-compressed, similarly to the above-described embodiments.

In addition, as shown in the embodiments of FIGS. 8, 10, 12 and 14 described above, a residual refrigerant discharge passage may be defined without defining the inner diameter (D1) (exactly, an outlet of the discharge port) of the discharge port 114 to be larger than the inner diameter (D2) of the discharge guide groove 133.

Then, a size of the discharge valve 150 that opens and closes the discharge port 114 may not be enlarged, thereby maintaining the responsiveness of the valve to that extent. Through this, when the size of the discharge valve 150 is enlarged, it may be possible to suppress the responsiveness deterioration of the valve, which may occur, as well as the resultant performance degradation and noise increase of the compressor.

In addition, as shown in the present embodiment of FIGS. 10, 12 and 14, the discharge valve 150 may be disposed at its original position, that is, a position having the center on the same axis as the center of the discharge guide groove 133, thereby sufficiently securing an interference distance with respect to the main bearing portion 112. Through this, a radial thickness of the main bearing portion 112 may be secured to stably support the rotary shaft to that extent.

In a rotary compressor according to the present embodiment, since the discharge port communicates with the refrigerant residual space defined between the vane slot and the discharge guide groove, it may be possible to suppress refrigerant from remaining in the refrigerant residual space even after the roller passes through the discharge guide groove. Through this, refrigerant pressure in the refrigerant remaining space may be suppressed from rising above the discharge pressure, thereby suppressing an increase in side pressure, friction loss or side wear between a vane and a vane slot into which the vane is inserted.

Furthermore, in the present embodiment, the center of the discharge port may be disposed to be concentric with the center of the discharge guide groove, and an inner diameter of the discharge port may be defined to be larger than that of the discharge guide groove. Through this, the discharge port is always in communication with the refrigerant residual space, thereby suppressing refrigerant pressure in the refrigerant residual space from rising above the discharge pressure.

In addition, in the present embodiment, while the discharge port communicates with the refrigerant residual space defined between the vane slot and the discharge guide groove, an outlet-side inner diameter of the discharge port may be defined to be the same as that of the discharge guide groove. Through this, it may be possible to maintain the diameter of the discharge valve so as to increase a responsiveness of the discharge valve and increase a degree of freedom of installation thereof.

In addition, in the present embodiment, the discharge port may be disposed to be inclined or stepped so that the discharge port communicates with the refrigerant residual space defined between the vane slot and the discharge guide groove while maintaining an inner diameter of the discharge port. Through this, a diameter of the discharge valve may be maintained while quickly discharging refrigerant in the refrigerant residual space, thereby increasing a responsiveness of the discharge valve and increasing a degree of freedom of installation thereof.

On the other hand, the above-described embodiments have been mainly described with reference to an example in which the roller and the vane are rotatably coupled to each other, but the wear avoiding portion may also be similarly applicable to a case where the roller and the vane are formed as a single body.

In addition, the above embodiments have been mainly described with reference to an example of one cylinder, but the wear avoiding portion may also be similarly applicable to a case of having a plurality of cylinders.

On the other hand, according to the present disclosure, since a roller reaction force may be further generated when using a high-pressure refrigerant, such as R32, the high-pressure refrigerant may be usefully applicable to a hinge vane type rotary compressor.

On the other hand, the present disclosure is advantageous when applying to a hinge vane type rotary compressor in which a BLDC motor is mounted on an air conditioner having a cooling capacity above 3 HP. In particular, the present disclosure may obtain high energy efficiency even at low-load and low-speed conditions where the density of the refrigerant increases and the inflow of liquid refrigerant is high.

What is claimed is:

1. A rotary compressor comprising:

a cylinder including a discharge guide groove and a vane slot, the discharge guide groove being disposed at a side of the vane slot;

a roller configured to orbit in the cylinder and including a hinge groove;

a vane having a first portion and a second portion, the first portion being inserted into the hinge groove of the roller, and the second portion being inserted into, and configured to slide along, the vane slot of the cylinder; and a bearing plate that engages with an axial surface of the cylinder and defines a discharge port that fluidly communicates with the discharge guide groove, wherein the discharge port fluidly communicates with a space defined between the vane slot and the discharge guide groove, wherein the discharge port overlaps at least partially with the vane in an axial direction, wherein the discharge guide groove fluidly communicates with the discharge port, and wherein the discharge port is concentric with the discharge guide groove.

2. The rotary compressor of claim 1, wherein an inner diameter of the discharge port is larger than an inner diameter of the discharge guide groove.

3. The rotary compressor of claim 1, wherein an inner diameter of the discharge port at a side opposite to the discharge guide groove is the same as an inner diameter of the discharge guide groove.

4. The rotary compressor of claim 1, wherein the discharge port comprises a discharge port inlet portion and a discharge port outlet portion, the discharge port inlet portion facing the discharge guide groove, and the discharge port outlet portion being opposite to the discharge guide groove, wherein an inner diameter of the discharge port inlet portion is larger than an inner diameter of the discharge port outlet portion, and wherein the inner diameter of the discharge port inlet portion is larger than an inner diameter of the discharge guide groove.

5. The rotary compressor of claim 1, wherein the bearing plate includes a discharge groove defined at an inlet of the discharge port that faces the discharge guide groove, wherein the discharge groove extends in a radial direction toward the vane, and wherein the discharge groove overlaps with the vane in the axial direction.

6. A rotary compressor comprising:

a cylinder including a discharge guide groove and a vane slot, the discharge guide groove being disposed at a side of the vane slot;

a roller configured to orbit in the cylinder and including a hinge groove;

a vane having a first portion and a second portion, the first portion being inserted into the hinge groove of the roller, and the second portion being inserted into, and configured to slide along, the vane slot of the cylinder; and a bearing plate that engages with an axial surface of the cylinder and defines a discharge port that fluidly communicates with the discharge guide groove, wherein the discharge port fluidly communicates with a space defined between the vane slot and the discharge guide groove, wherein the discharge guide groove fluidly communicates with the discharge port, wherein the bearing plate includes a discharge passage extending between the discharge guide groove and the space, and wherein the discharge passage comprises at least one of a hole or a groove that extends through between the discharge guide groove and the vane slot.

7. A rotary compressor comprising:

a cylinder including a discharge guide groove and a vane slot, the discharge guide groove being disposed at a side of the vane slot;

a roller configured to orbit in the cylinder and including a hinge groove;

a vane having a first portion and a second portion, the first portion being inserted into the hinge groove of the roller, and the second portion being inserted into, and configured to slide along, the vane slot of the cylinder; and a bearing plate that engages with an axial surface of the cylinder and defines a discharge port that fluidly communicates with the discharge guide groove, wherein the discharge port overlaps at least partially with the vane slot or the hinge groove in an axial direction, wherein the discharge port is coaxial with the discharge guide groove in the axial direction, and wherein an inner diameter of the discharge port at a side that faces the discharge guide groove is larger than an inner diameter of the discharge guide groove.

* * * * *